US005628842A

United States Patent [19]

Wilmotte et al.

[11] Patent Number: 5,628,842

[45] Date of Patent: May 13, 1997

[54] METHOD AND APPARATUS FOR CONTINUOUS TREATMENT OF A STRIP OF HOT DIP GALVANIZED STEEL

[75] Inventors: Stephan Wilmotte, Chaudfontaine; Michel Dubois, Boncelles, both of Belgium; Erik Van Perlstein, Beverwijk, Netherlands; Simon Vandenbruaene, Gent; Michel Beguin, Nandrin, both of Belgium

[73] Assignees: Centre de Recherches Metallurgiques-Centrum Voor Research In de Metallurgie, Brussels; Cockerill Sambre S.A., Seraing, both of Belgium; Hoogovens Groep BV, Ijmuiden, Netherlands; N.V. Sidmar, Ghent, Belgium

[21] Appl. No.: 517,262

[22] Filed: Aug. 21, 1995

Related U.S. Application Data

[62] Continuation of PCT/BE94/00094, Dec. 14, 1994.

[30] Foreign Application Priority Data

Dec. 24, 1993 [BE] Belgium ..... 0930153

[51] Int. Cl.[6] ..... C21D 1/42

[52] U.S. Cl. ..... 148/526; 148/533

[58] Field of Search ..... 148/526, 529, 148/533

[56] References Cited

U.S. PATENT DOCUMENTS

| | | | |
|---|---|---|---|
| 5,074,924 | 12/1991 | Ushioda et al. | 148/533 |
| 5,409,553 | 4/1995 | Sagiyama et al. | 148/526 |

FOREIGN PATENT DOCUMENTS

| | | | |
|---|---|---|---|
| 2941850 | 4/1980 | Germany | 148/526 |
| 55-085623 | 10/1985 | Japan . | |
| 61-223174 | 10/1986 | Japan . | |
| 62-130268 | 6/1987 | Japan . | |
| 3-079748 | 4/1991 | Japan . | |
| 4-333552 | 11/1992 | Japan . | |
| 5-247619 | 9/1993 | Japan . | |
| WO9212271 | 7/1992 | WIPO . | |

OTHER PUBLICATIONS

Jordan, C.E., "Interfacial layer development in hot–dip galvanneal coatings on interstitial free (if) steel," Metallurgical And Materials Transactions A Physical Metallurgy And Materials Science, Oct. 1994, Warrendale, P.A. U.S., pp. 2101–2109.

*Primary Examiner*—George Wyszomierski

*Attorney, Agent, or Firm*—Jacobson, Price, Holman & Stern, PLLC

[57] ABSTRACT

A method and apparatus for continuously treating a strip of hot dip-galvanized steel. The method comprises the steps of rapidly reheating the strip to a predetermined temperature between 460° C. and 600° C., with a heating flux greater than 180 kWatts per meter squared based for each face of the strip; maintaining the strip at a substantially constant temperature for a predetermined period of time lasting between 10 and 30 seconds; and subsequently cooling the strip rapidly to a temperature below 420° C., using a cooling flux of a magnitude greater than 100 kWatts per meter squared for each face of the strip. The step of rapidly reheating is performed following a drying operation conducted on the strip as it exits from a zinc bath. The apparatus comprises various elements for performing the method, as well as a vessel containing the zinc bath, redirecting rolls which define an upward and substantially vertical trajectory for the strip and a drying mechanism disposed along the trajectory downstream of the vessel's exit. Preferably, the rapidly heating of the strip is accomplished using an induction furnace operating at a frequency between 100 and 500 kHz, and the rapid cooling is provided by nozzles which, in turn, deliver a mist or fine spray of water and air.

10 Claims, 2 Drawing Sheets

METHOD AND APPARATUS FOR CONTINUOUS TREATMENT OF A STRIP OF HOT DIP GALVANIZED STEEL

CROSS REFERENCE TO RELATED APPLICATION

This is a continuation application of PCT/BE94/00094 filed Dec. 14, 1994.

BACKGROUND OF THE INVENTION

The invention relates to a method and apparatus for continuously treating a strip of hot dip galvanized steel.

A known treatment, "galvannealing", consists of heating a strip of hot dip galvanized steel up to a chosen temperature, maintaining it at this temperature, and then cooling. This treatment is intended to provide diffusion of the iron of the strip into the zinc of the coating, to the extent of yielding an iron content in the amount of 7 to 13% of the coating. Iron contents outside this range produce alloys which, if the iron concentration is too high, involve powdering when the strip is subjected to deep drawing or the like, or if the iron concentration is too low, the steel strip cannot be satisfactorily welded.

In current practice, galvannealing is carried out in an apparatus wherein the strip undergoing treatment passes through at least two vertical runs (ascending and descending). This type of apparatus typically can also be used for producing a conventional hot dip galvanized strip.

In the classical galvannealing operation, a furnace for heating and maintaining the strip at temperature is disposed above the galvanizing bath, immediately downstream of the air jet wiping apparatus. This furnace is generally retractable, not being used in the production of conventional hot dip galvanized strips. A first cooling apparatus is disposed above the furnace, typically comprised of a group of air blowers. The purpose of the cooling is to avoid damage to the coating by the redirecting rolls which guide the strip for the return run downward from the altitude reached in the process. The height of the combination of the furnace and the cooling apparatus determines the height of the upward run of the strip, which generally does not exceed 50 m because of susceptibility to vibrations produced at the level of the aforementioned wiping air jets. Customarily, a second cooling apparatus, e.g. a second group of blowers, is disposed at the beginning of the downward movement which follows the galvannealing operation.

In such an installation, the coated strip leaves the zinc bath at a temperature of approximately 450°–480° C. and passes through a drying segment employing air jets, following which it is subjected to the galvannealing operation in which it is heated to a temperature in the range 460°–600° C. chosen depending on the grade of the steel employed. It then undergoes cooling, first by an initial group of blowers at the end of the upward run and then by a second group at the beginning of the downward run. The temperature of the strip following this cooling is one which is suitable in light of intended further treatment or handling of the coated strip.

Under current practice, heating of the strip is provided by a direct fired furnace or an induction furnace, capable of raising the strip temperature by 50°–100° C. but at a relatively low heating rate, e.g. 6° C./sec for a strip 0.7 mm thick, in the case of a burner-equipped furnace, and 30° C./sec in the case of an induction furnace operating at a 10 kHz frequency. The energy efficiency of gas burners is low, on the order of 30%. Further, a classical induction furnace with multi-turn windings and with longitudinal or transverse magnetic flux, has sometimes to be adapted to correct transverse irregularity in the temperature.

The means of maintaining the strip at the elevated galvannealing temperature generally comprise an insulated channel, possibly equipped with heating means, e.g. electrical or gas heating means. The temperature-maintenance section occupies approximately one-fourth of the height of the upward vertical trajectory of the strip. The combination of the heating furnace and the temperature-maintenance means must be sufficiently long to provide a duration of passage greater than 10 seconds, preferably greater than 15 seconds, at a temperature above 450° C.

Such an arrangement does not allow optimal conditions for galvannealing. The fact that the heating rate of the galvanized strip is only moderate makes it necessary to have a somewhat long heating section. This limits the length of the constant-temperature-maintenance section where iron is caused to diffuse from the strip into the zinc. As a result, higher temperatures must be used to achieve the same desired diffusion. Also, it is well known that higher temperatures in the temperature-maintenance section, while achieving a shorter time at the galvannealing temperature, do so at the cost of increased risk of powdering during deep drawing operations.

SUMMARY OF THE INVENTION

A primary object of the present invention is to alleviate the above-mentioned disadvantages, by means of a thermal cycle which provides excellent conditions for galvannealing. In contrast to cycles according to the state of the art, the inventive method provides a generally rectangular temperature vs. time cycle, which includes maintaining the strip at a substantially constant temperature for a long duration, with the constant temperature being relatively low, enabled by the longer treatment duration.

The method of continuously treating a hot dip-galvanized steel strip, which method is an object of the present invention, includes the following steps after wiping the strip at the exit from the zinc bath:

rapidly reheating the strip to a temperature in the range of 460°–600° C., with a heating flux greater than 180 kW/sq m for each face of the strip;

maintaining the strip at a substantially constant temperature during a period in the range of 10–30 sec;

subsequently cooling the strip rapidly to a temperature below 420° C., using a cooling flux greater than 100 kW/sq m for each face of the strip.

The temperature to which the strip is heated depends on the grade of the steel being treated, as does the temperature program in a traditional galvannealing operation; however, in practice the temperature used may be lower than that in traditional galvannealing, e.g. according to the invention the temperature may be in the range 460°–560° C.

The heating flux and the cooling flux, expressed in units of kW/sg m, are concepts well known to those skilled in the art, particularly practioners of heat treatment of sheet steel. The heating/cooling flux can readily be converted to a rate of variation of the temperature, as a function of the thickness of the product.

For example, a heating flux of 180 kW/sq m for each face of the product represents a heating rate of 100° C. per second for a sheet 0.7 mm thick, and 60° C./sec for a sheet of thickness 1.25 mm. And a cooling flux of 100 kW/sq m for each face of the product represents a cooling rate of 54°

C./sec for a 0.7 mm thick sheet, and 30° C./sec for a 1.25 mm thick sheet.

According to an advantageous embodiment of the inventive method, rapid heating of the strip is provided by a high frequency induction furnace, e.g. of frequency in the range 100–500 kHz. This embodiment enables very high heating power, and thus enables high heating rates to be achieved, e.g. greater than 150° C./sec for a 0.7 mm thick strip in a 100 kHz furnace.

According to a preferred variant of this advantageous embodiment, one combines the use of a high frequency induction furnace with the use of a single-loop inductor comprising, for example, a sheet of copper surrounding the strip being treated. This advantageous variant improves, i.e. makes more uniform, the transverse temperature distribution in the strip. The problem of periodic temperature variations along the width of the strip is thereby overcome, with the lateral edges being reheated to the same temperature as the center region.

Further according to the invention, the zone in which the temperature of the strip is maintained substantially constant is comprised of a chamber which may be provided with re-heating means such as gas burners to supply heat to compensate for local losses of heat.

The invention further provides that the strip may be cooled to a temperature below 350° C. upon exiting from the temperature-maintenance zone. According to an advantageous embodiment of the method, the operating parameters of the cooling system are regulated to provide a cooling flux greater than 125 kW/sq m for each face of the product.

In a practical embodiment of the invention, the strip is cooled rapidly by means of nozzles delivering a mist or fine spray comprised of water and air.

It should be mentioned (as indicated above) that the use of induction heating to increase the temperature enables improved control of the galvannealing operation, provided that, and to the extent that, the distribution of temperatures in the strip is maximally and sufficiently homogeneous at the entrance to the furnace, which depends on the conditions at the exit of the zinc bath. In this connection, it may be useful, according to the invention, to provide a temperature-equalization section between the section of rapid temperature increase and the substantially constant-temperature maintenance zone. Such an equalization section may be equipped, e.g. with a plurality of burners disposed along the transverse dimension of the strip, which burners are provided with individual means for regulating their respective fuel supplies.

An exemplary embodiment of an apparatus according to the invention will be described hereinbelow in more detailed fashion, with reference to the accompanying drawings.

DETAILED DESCRIPTION OF THE PREFERRED EMBODIMENTS

Figure 2:
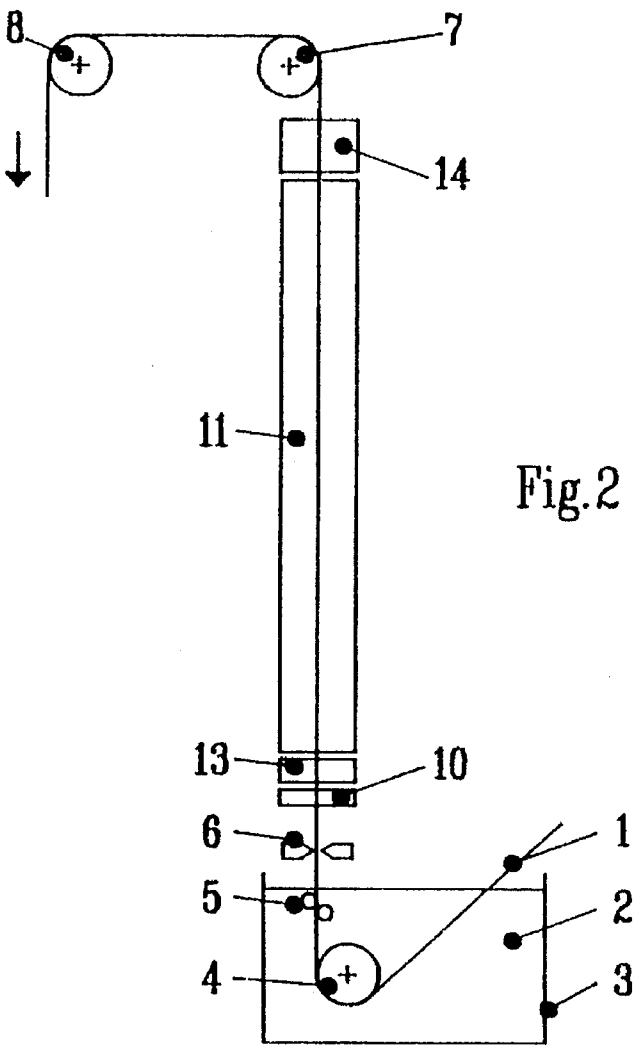
FIG. 2 schematically shows an embodiment according to the invention.

The schematic drawings include only those elements necessary for comprehension of the invention. For purposes of clarity, elements which are identical or analogous have been assigned like reference numerals in the drawings.

Figure 1:
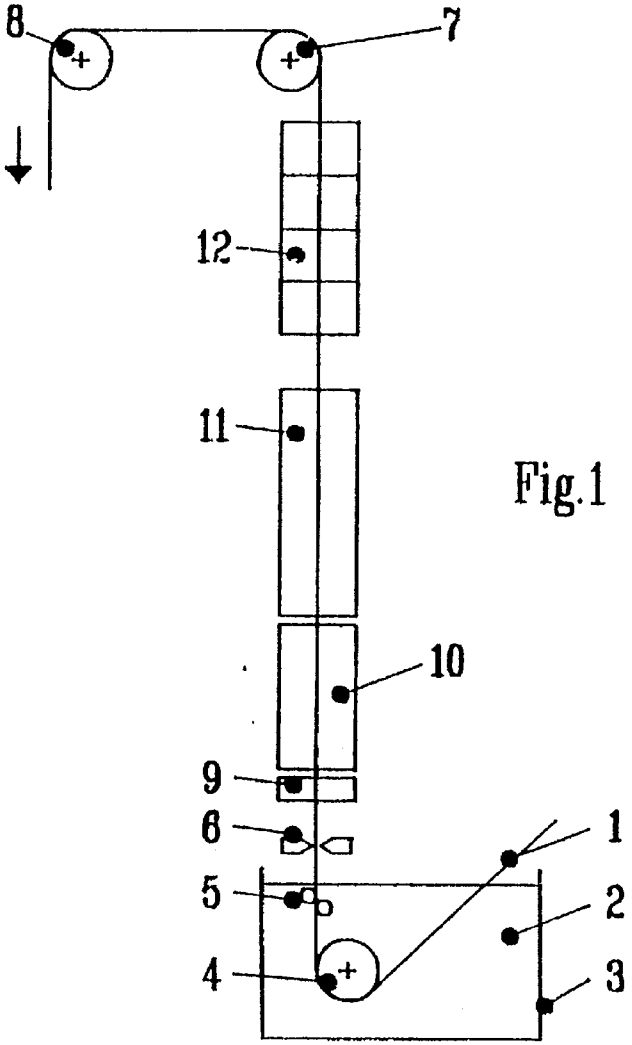
FIG. 1 shows schematically a typical "galvannealing" installation according to the state of the art.

FIG. 1 shows a typical apparatus for treating a strip of hot dip galvanized steel, according to the state of the art. The steel strip 1 coming from an annealing furnace is immersed in a bath of molten zinc 2 contained in a galvanizing tank 3. The strip 1 is redirected by a first redirecting roll 4 and leaves the zinc bath 2 in a vertical direction, guided by rolls 5. Upon exiting the bath 2, the steel strip 1 passes through an air-jet wiping station 6 whereby the thickness of the zinc layer on the strip 1 is regulated.

The now-coated steel strip 1 executes an upward vertical trajectory to a second redirecting roll 7, a horizontal trajectory to a third redirecting roll 8, and a downward vertical trajectory to a succeeding operation.

In the lower part of the upward trajectory, slightly above the dryer 6, a furnace is disposed which is comprised of a heating section (zones 9 and 10) followed by a section in which the temperature of the strip is maintained substantially constant. This furnace enables the galvannealing process to be carried out, wherein the strip is heated and maintained at a temperature selected to cause iron to migrate into the zinc under prescribed conditions. All or part of this furnace is retractable to allow the galvanized steel strip to be produced in the conventional manner without galvannealing treatment; in particular, the furnace may be replaced by a device for minimizing zinc spangle, which devices are often used in conventional galvanizing. The temperature of the strip exiting the drying is approximately 450° C.; after heating in the furnace, the temperature is raised to 460°–600° C. depending on the grade of the steel being treated.

In the conventional installation an apparatus 12 for cooling the hot dip galvanized steel strip is disposed above the furnace, i.e. in the region above the upward vertical trajectory. Generally the cooling apparatus 12 is comprised of a group of air blowers. These blowers cool the galvanized strip (whether or not after galvannealing) to a temperature low enough to prevent the strips from sticking to the redirecting rolls 7.

In such an installation, the thermal cycle departs significantly from the so-called "rectangular" cycle; this departure introduces control problems in the galvannealing process. Notably, difficulties arise in the control of the treatment and ultimately the control of the composition of the iron-zinc alloy, particularly where the steel strip is thick and the zinc coating is thin.

These difficulties are overcome by the apparatus according to the invention, an embodiment of which is illustrated in FIG. 2 and described hereinbelow.

The differences between the method and apparatus of the present invention and that of the prior art do not relate to the hot dip galvanization of the strip and the wiping of the zinc coating.

An essential difference lies in the galvannealing furnace, which according to the invention has a short heating section 10 for rapid heating of the galvanized steel strip, followed by a short zone 13 for equalization of temperatures and a long zone 11 in which the temperature is maintained substantially constant. A rapid cooling section 14 is disposed at the exit of the furnace; this rapid cooling section 14 is equipped with nozzles which deliver a mist or fine spray comprised of water and air.

As mentioned above, in current practice the length of the upward vertical trajectory (4, 7) may not exceed approximately 50 m, in particular because of transverse vibrations of the strip and the associated difficulty in controlling the thickness of the coating. In convention apparatuses such as those illustrated in FIG. 1, the cooling section 12 ahead of the first redirecting roll 7 is long, as is the heating furnace 10, leaving little vertical space available for the zone 11 in which the strip is held at a substantially constant galvannealing temperature.

According to the invention, the sections for heating and cooling of the strip are substantially shortened, thereby enabling substantial lengthening of the time in which the strip is held at the galvannealing temperature. As a result, temperature control is improved, and thereby the course of the treatment is improved. Moreover, it becomes possible to maintain the strip at a temperature lower than that used in the classical method, and in particular to do so for a long duration. This has a beneficial effect on the properties of the coating.

Figure 3:
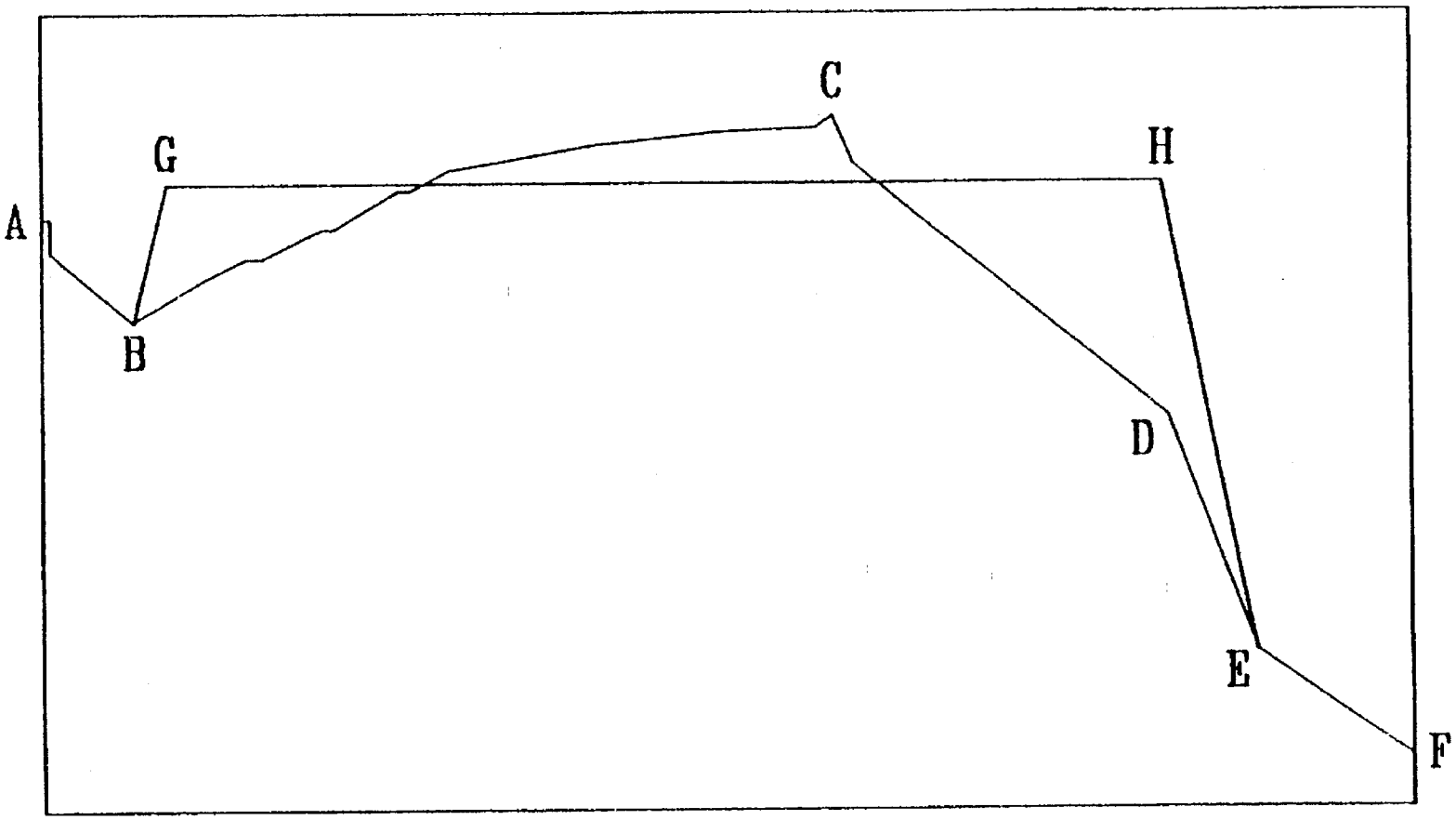
FIG. 3 is a temperature vs. time plot for the thermal cycle according to the invention and a conventional thermal cycle.

The described difference in the heat treating cycles between the classical method and the inventive method is illustrated in FIG. 3, which shows a representative temperature-vs.-time plot for the two methods. In that plot, the segment AB represents the slight cooling of the strip which occurs following the exit from the zinc bath (point A representing the exit point), and the segment EF represents the temperature decrease resulting from the forced cooling ahead of the contact of the strip with the redirecting roll 7.

The classical thermal cycle BCDE shows the gradual increase in the temperature of the product, which is difficult to control. In contrast, the thermal cycle BGHE according to the invention, with rapid heating BG and rapid cooling HE, enables a long period GH in which the product is held at a substantially constant temperature.

As an example of an application of the inventive method, a strip of steel comprising 0.005% C, 0.110% Mn, 0.009% Ti, and 0.015% Nb, having thickness 0.7 mm and width 1500 mm and passing at 120 m/min, was subjected to galvannealing.

At the exit of the zinc bath, the strip underwent slight cooling from 460° C. to 445° C., at which temperature it entered an induction furnace having a heating flux of 190 kW/sq m for each face of the strip, where the strip was further heated to 490° C. The strip was maintained at the 490° C. temperature for 15.5 seconds, after which it was subjected to intensive cooling in a chamber 3 m long. The first section of the cooling chamber was equipped with a battery of water/air misting jet nozzles providing a cooling flux of 180 kW/sq m for each face of the strip. The strip exited this chamber at 330° C.

We claim:

1. A method for continuously treating a strip of hot dip-galvanized steel to galvanneal said strip, said method comprising the steps of:

removing a galvanized steel strip from a molten zinc bath;

rapidly reheating the strip to a temperature between 460° and 600° C., with a heating flux greater than 180 kilowatts per meter squared for each side of said strip;

maintaining the strip at a substantially constant temperature for a period of time lasting between 10 and 30 seconds; and rapidly cooling the strip to a temperature below 420° C. with a cooling flux greater than 100 kilowatts per meter squared for each side of the strip.

2. The method of claim 1, wherein said step of rapidly reheating is performed using an induction furnace operating at a frequency between 100 and 500 kHz.

3. The method of claim 1, wherein said step of rapidly reheating is performed using a high frequency induction furnace and a single-loop inductor.

4. The method of claim 3, wherein said single-loop inductor comprises a sheet of copper surrounding the strip.

5. The method of claim 1, wherein said strip is maintained at a substantially constant temperature in a chamber or channel provided with a heat insulating lining.

6. The method of claim 1, wherein said strip is maintained at a substantially constant temperature in a chamber or channel having re-heating means.

7. The method of claim 1, wherein said strip is maintained at a substantially constant temperature in a chamber or channel having re-heating means, said reheating means comprising at least one gas burner.

8. The method of claim 1, wherein said step of rapidly cooling the strip comprises the step of rapidly cooling the strip to a temperature below 350° C.

9. The method of claim 1, wherein said step of rapidly cooling the strip comprises cooling the strip rapidly with a cooling flux of a magnitude greater than 125 kWatts per meter squared for each face of the strip.

10. The method of claim 1, wherein said step of rapidly cooling the strip comprises cooling the strip rapidly using nozzles which deliver mists or fine sprays of water and air.

* * * * *